US005632549A

United States Patent [19]

Fang

[11] Patent Number: 5,632,549

[45] Date of Patent: May 27, 1997

[54] FASTENER FRAME WITH BUTTON SWITCH

[76] Inventor: Chung-Ho Fang, No. 41, Shin Le Rd., Tainan City, Taiwan

[21] Appl. No.: 503,878

[22] Filed: Jul. 18, 1995

[51] Int. Cl.[6] ..... F21L 15/08

[52] U.S. Cl. ..... 362/108; 362/103; 362/252; 362/800

[58] Field of Search ..... 362/103, 104, 362/105, 108, 800, 252, 811, 191; 340/321, 331, 332; 2/338

[56] References Cited

U.S. PATENT DOCUMENTS

| | | | |
|---|---|---|---|
| 3,153,745 | 10/1964 | Gurian et al. | 362/103 |
| 4,523,258 | 6/1985 | Morse | 362/108 |
| 5,070,436 | 12/1991 | Alexander et al. | 362/108 |
| 5,151,678 | 9/1992 | Vetri et al. | 362/103 |
| 5,245,516 | 9/1993 | de Haas | 362/108 |
| 5,381,318 | 1/1995 | Fang | 362/108 |
| 5,434,759 | 7/1995 | Endo et al. | 362/108 |

*Primary Examiner*—James C. Yeung
*Attorney, Agent, or Firm*—Morton I. Rosenberg; David I. Klein

[57] ABSTRACT

A fastener frame with a button switch incorporated is provided which includes a socket unit (E) connected to a belt (8) with the belt (8) having sources of luminosity (81). When a plug (6) is connected to the belt socket (14), lugs (611) on the front end of plug rod (61) are engaged within setting holes (141). Simultaneously, a starting rod (62) formed at the middle of the plug (6) presses against a push button (31) mounted on a driving circuit module (3). Initiation of the push button (31) initiates the driving circuit to energize the sources of luminosity (81) as well as the luminous sources (25) formed in a top cover (2). In this manner, a warning device is provided which alerts drivers of passing vehicles that the wearer is in the vicinity.

4 Claims, 8 Drawing Sheets

FASTENER FRAME WITH BUTTON SWITCH

BACKGROUND OF THE INVENTION

1. Field of the Invention

The present invention relates to a fastener frame with a push-button switch. More particularly, the present invention relates to a device for incorporation into an alarm belt or vest with luminosity, providing a device having fastening efficacy and controllable luminosity in different flashing states in fastening.

2. Prior Art

As people, such as joggers, walkers, street cleaner, traffic directors, etc., often go out in the early morning or night, they often draw attention to themselves by wearing a reflector belt or vest to indicate where they are to drivers of passing vehicles. But, the warning that results from a reflector depends upon impingement by an external light source. Therefore, the meaningful warning distance is limited, and it does not provide great safety. However, there is a type of active luminous warning accessory on the market. The prior art alarm belt, for example, provides a source of luminosity fixed on the belt, with a battery unit for powering the warning light output. Referring to FIG. 1, a conventional alarm belt is shown with push-button switch B on a belt buckle A. The switch B is used to control the source of luminosity D, such being lit or extinguished on the belt C. But, during use, due to the work or movement of the user, the upper part of the user's body or an object can unexpectedly touch the push-button switch B to cut off the warning light. In such a case, if the user does not discover that the warning light has been shut off, a dangerous condition results.

SUMMARY OF THE INVENTION

The present invention includes a driving circuit module and batteries disposed in a socket unit. Insertion of a plug into the bell socket of the socket unit can turn on the driving circuit module for controlling the lighting or extinguishing of the source of luminosity. Due to the control switch being responsive to the insertion of the plug into the socket unit, accidental contact with the switch is avoided.

DESCRIPTION OF THE PREFERRED EMBODIMENTS

Figure 1:
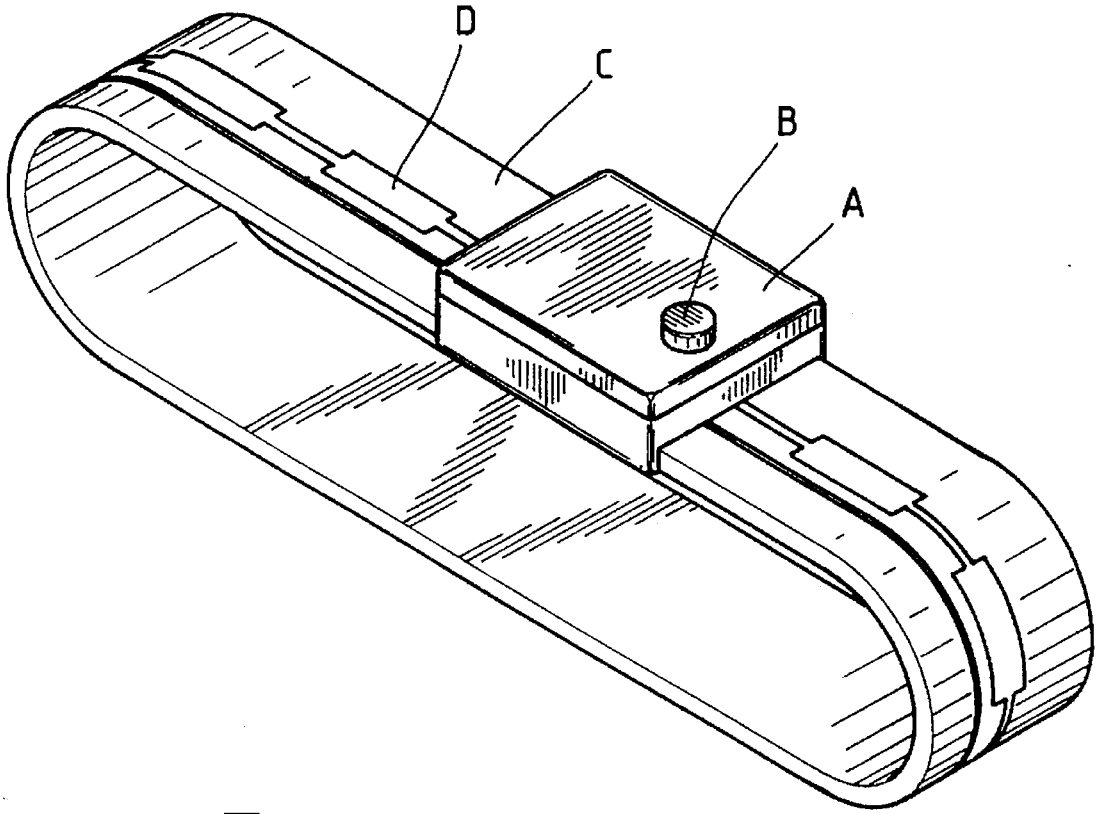
FIG. 1 PRIOR ART
FIG. 1 is a perspective view of a conventional alarm belt.
Figure 2:
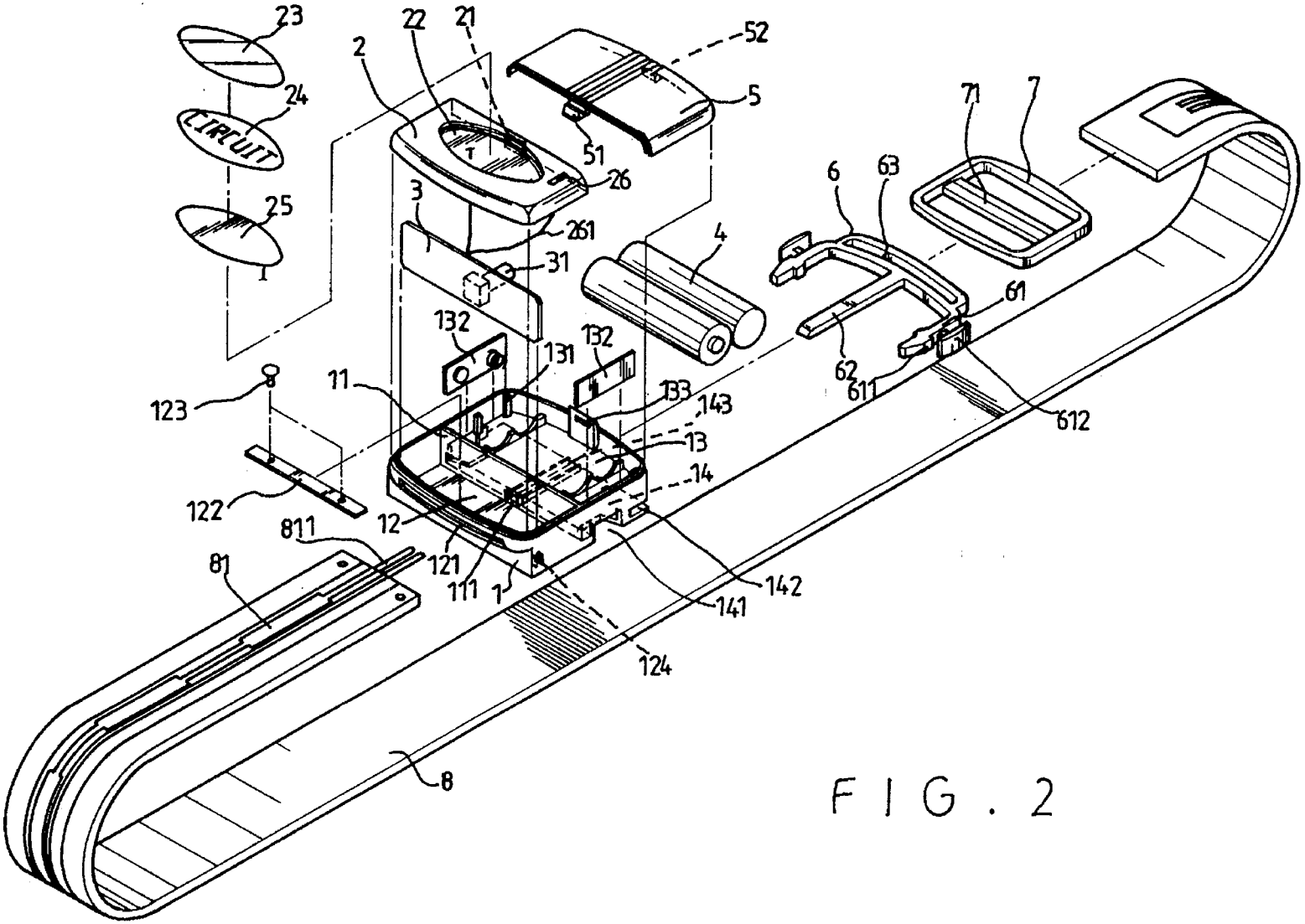
FIG. 2 is an exploded view of the present invention.

Firstly, referring to FIG. 2, the warning device of the present invention is shown to include (1) a socket unit E formed by the combination of a cabinet 1, a top 2, a driving circuit module 3, batteries 4, and a battery cover 5, (2) a plug 6, (3) a belt buckle 7, and (4) a belt 8.

The cabinet 1 is a case that is open on its top. A spacer 11 with a hole 111 separates the cabinet 1 into two compartments, one being a circuit compartment 12, and the other being a battery compartment 13. The flat bottom surface of the battery compartment 13 is higher than the bottom surface of the circuit compartment 12. Beneath the lower surface of the bottom of the battery compartment 13 there is formed a bell socket 14 for receiving the plug 6 therein. The bell socket 14 has two setting holes respectively formed through the two side walls thereof, with each side wall having a guide slot 142 formed therein. A guide way 143 is formed at the center of the bottom of socket 14 and there is an elongated slot 121 through the upper portion of the rear wall of the circuit compartment 12 for passage of the belt 8 therethrough to the inside of the circuit compartment 12. The belt 8 is fixed within the circuit compartment 12 by a fixing piece 122 by screws 123.

Two fixture blocks 124 are respectively formed on the interior of the two sides of the circuit compartment 12 for vertical engagement and securement of the driving circuit module 3. Two pairs of fixtures 131 are formed on the interior side of the two side walls of the battery compartment 13 for respectively capturing two sockets 132. A locking hole leaf 133 is disposed on upper portion of the front wall of the battery compartment 13 for locating the battery cover 5. The top 2 is an arcuate shaped cover plate corresponding to the contour of the circuit compartment 12 of the cabinet 1, covering it and being affixed thereon with glue or by heat-sealing. The top 2 has a hole 21 formed through the upper end of one end wall thereof. A flute 22 is formed on the top side for holding a transparent cover 23, an indicia carrying member 24, and two luminous sources 25. A tiny hole (too small to indicate on the drawing) is formed through the flute 22 for passage of the wire 251 from the luminous sources 25. A sensor 26 is located on the surface of the top 2 and connected with a wire 261 and the wire 251 to the driving circuit module 3.

The driving circuit module 3 has a driving circuit disposed on a plate for driving the luminous sources 25 and the sources of luminosity 81 disposed on the belt 8. Each of the two sides of the plate are engaged by the respective fixture blocks 124 located on the bottom surface of the circuit compartment 12 of the cabinet 1. A push-button switch 31 is connected to the driving circuit module and mounted on one side of the plate facing the hole 111 on the spacer 11.

The battery cover 5 is a cover having a shape corresponding to the contour of battery compartment 13 of the cabinet 1, in which the front and back ends have a latch 51 and a lug 52 formed respectively thereon. When covering the cabinet 1, the latch 51 on the front end is first inserted into the hole 21 of the top 2. Then, the lug 52 on the back end is slid into the locking hole of the locking hole piece 133 of the battery compartment 13.

A plug 6 consists of two elastic plug rods 61 respectively disposed on the two sides thereof, and a starting rod 62 formed at the center of the plug 6. The outside surface of the front end of each plug rod 61 has a lug 611 formed thereon. Behind the lug 611, there is formed a push-button 612. The connecting member extending between the plug rods 61 and from which the starting rod 62 extends has an elongated slot 63 formed therein for passage therethrough and connection of the belt 8.

The belt buckle 7 is a collar with a cross bar 71 formed in the middle for passage therethrough of the belt 8 and providing adjustment of the length of belt 8.

The belt 8 is a common fabric belt having several sources of luminosity 81 adhered on a surface thereof in equidistantly spaced relationship. The sources of luminosity 81 can be EL (electroluminescent) or LED (light emitting diode) devices, and connected with two wires 811 to the driving circuit module 3.

Figure 3:
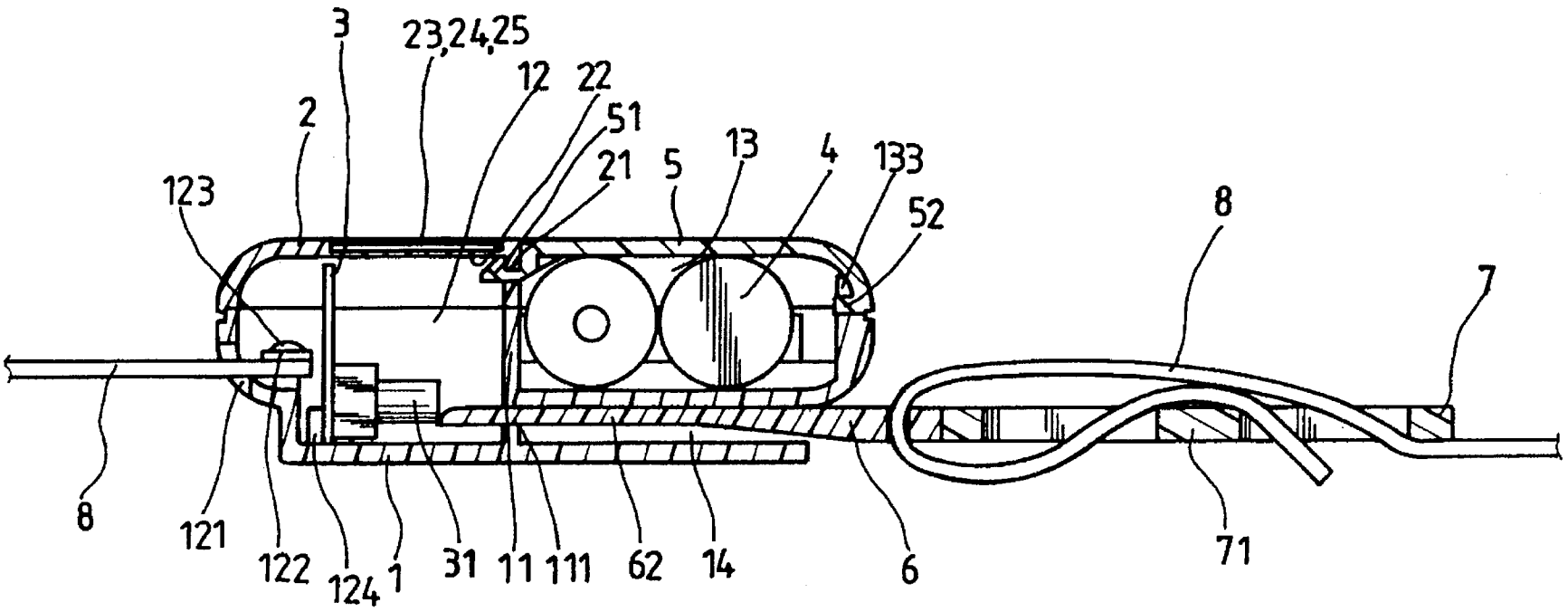
FIG. 3 is a cross-sectional view of the present invention.

Combining the above-mentioned parts, referring to FIG. 3, a cabinet 1, top 2, module of driving circuit 3, battery 4 and battery cover 5 form the socket unit E connected to the belt 8, the belt 8 having sources of luminosity 81 disposed thereon. When the plug 6 is plugged into the bell socket 14 in the cabinet 1 of the socket unit E, the lugs 611 on the front end of the plug rods 61 are engaged within the respective setting holes 141 formed in the side walls of the bell socket 14. Meanwhile, the starting rod 62 at the middle of plug 6 passes through the hole 111 of the spacer 11, inside of the cabinet 1, along the guide way 143 to press against the push-button 31 disposed on the driving circuit module 3. Pressing the push-button 31 starts the driving circuit to energize the sources of luminosity 81 on the belt 8 and the luminous sources 25 in the top 2. Thus, the belt 8 gives out an obvious light as a warning, and the indicia carrying member 24 disposed over the luminous sources 25 in the top 2 has a transparent pattern that is lit by the luminous sources 25 to indicate the operation of the system.

The sensor 26 located on the top 2 can control the driving circuit, to switch it on or off depending on the intensity of the surrounding light. If the intensity is strong, as in the daytime, the sensor 26 switches the driving circuit off, to cut off the light of luminosity sources 81 and luminous sources 25. Conversely, when it is dark, the driving circuit is turned on so the sources of illumination provide light. When the plug 6 is removed from the socket unit E, the push-button switch 31 is switched off to disconnect the battery.

The above-mentioned operation of the present invention is such that the plug 6 is plugged in or removed from the socket unit E to control the lighting or extinguishing of the luminosity sources. In another embodiment, the plug 6 is plugged into the socket unit E at different positions to control the driving circuit switching to be on, off, or flashing.

Figure 4:
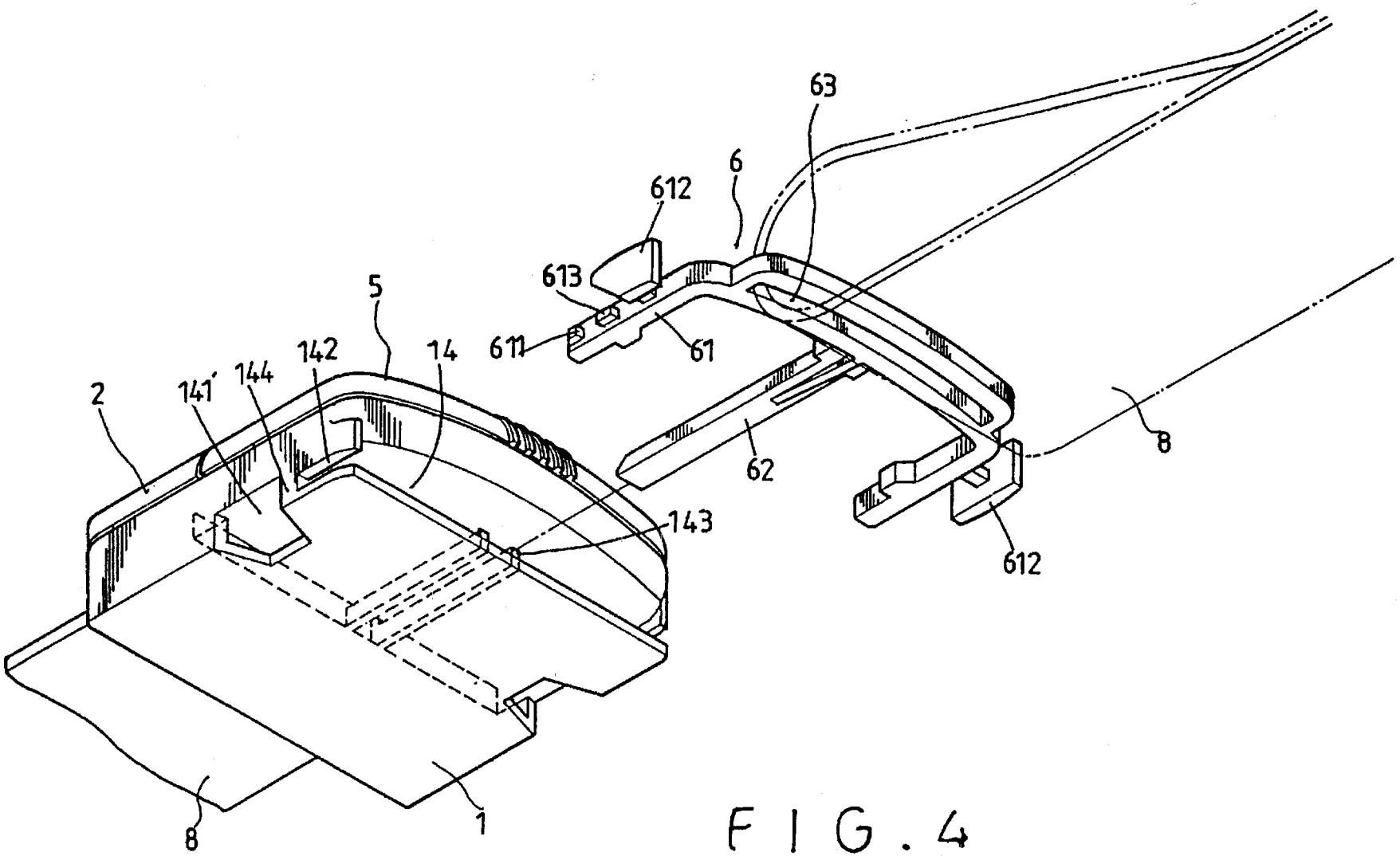
FIG. 4 is a bottom perspective view of the present invention showing the plug removed.

Referring to FIG. 4, there is shown, an alternate design of the bell socket 14 of the socket unit E and the plug rods 61 of the plug 6.

The plug 6, has a lug 613 extending from a position between the lug 611 disposed on the front end of each plug rod 61, and the push-button 612. Corresponding to the lug 611 and 613 of each plug rod 61, the two side walls of the bell socket 14 have an elongated setting hole 141' formed therethrough, with the spacing between the setting hole 141' and the original guide slot 142 corresponding to the spacing between the lug 611 and lug 613, that spacing being formed by a block 144.

Figure 5:
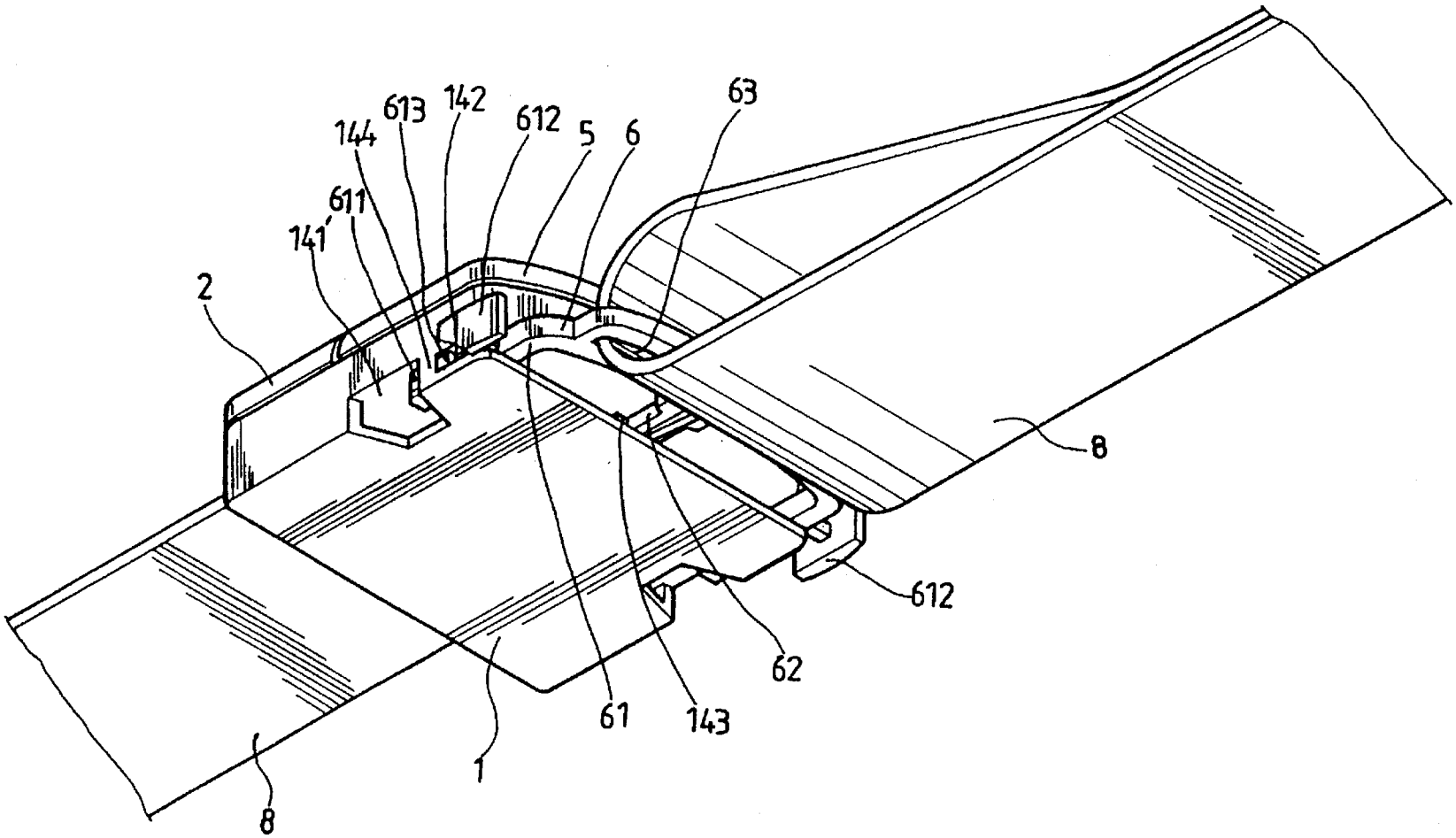
FIG. 5 is a bottom perspective view of the present invention showing the plug engaged within the socket.
Figures 6A, 6B:
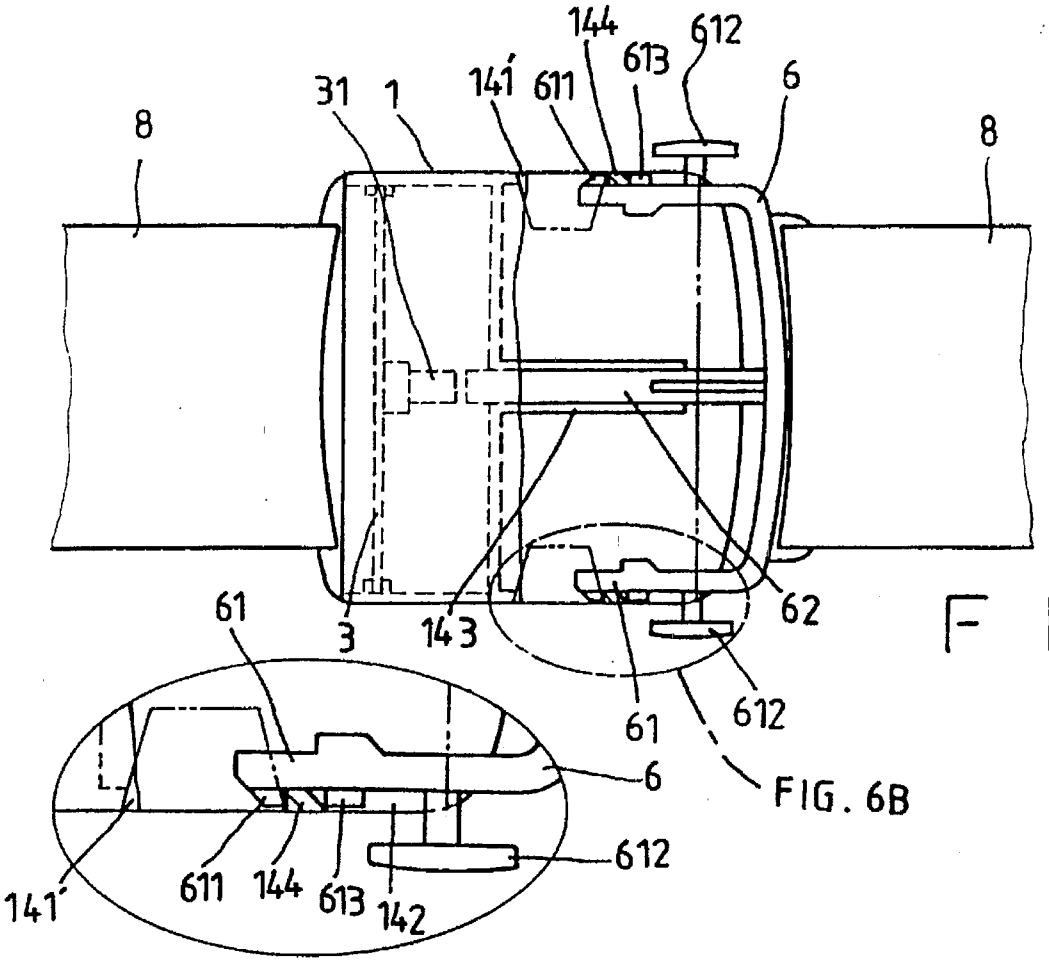
FIG. 6A is a bottom plan view, partially cut away, of the present invention showing insertion of the plug.
FIG. 6B is an enlarged portion of the present invention shown in FIG. 6A.

Combining the above-mentioned parts, as shown in FIGS. 5, 6A and 6B, the plug 6 is plugged into the socket unit #, so that the lugs 611 and the lugs 613 are respectively disposed in the setting slot 141' and guide slot 142 on each side of the socket E, with the blocks 144' disposed between the respective lugs. With the plug in that position, the starting rod 62 passes through the hole 111 of the spacer 11 and through the guide way 143 in the bell socket but does not switch the push-button switch 31 of the driving circuit module 3. In this case, the plug 6 is just fastened to the socket unit E, and does not start the sources of luminosity to light.

Figures 7A, 7B:
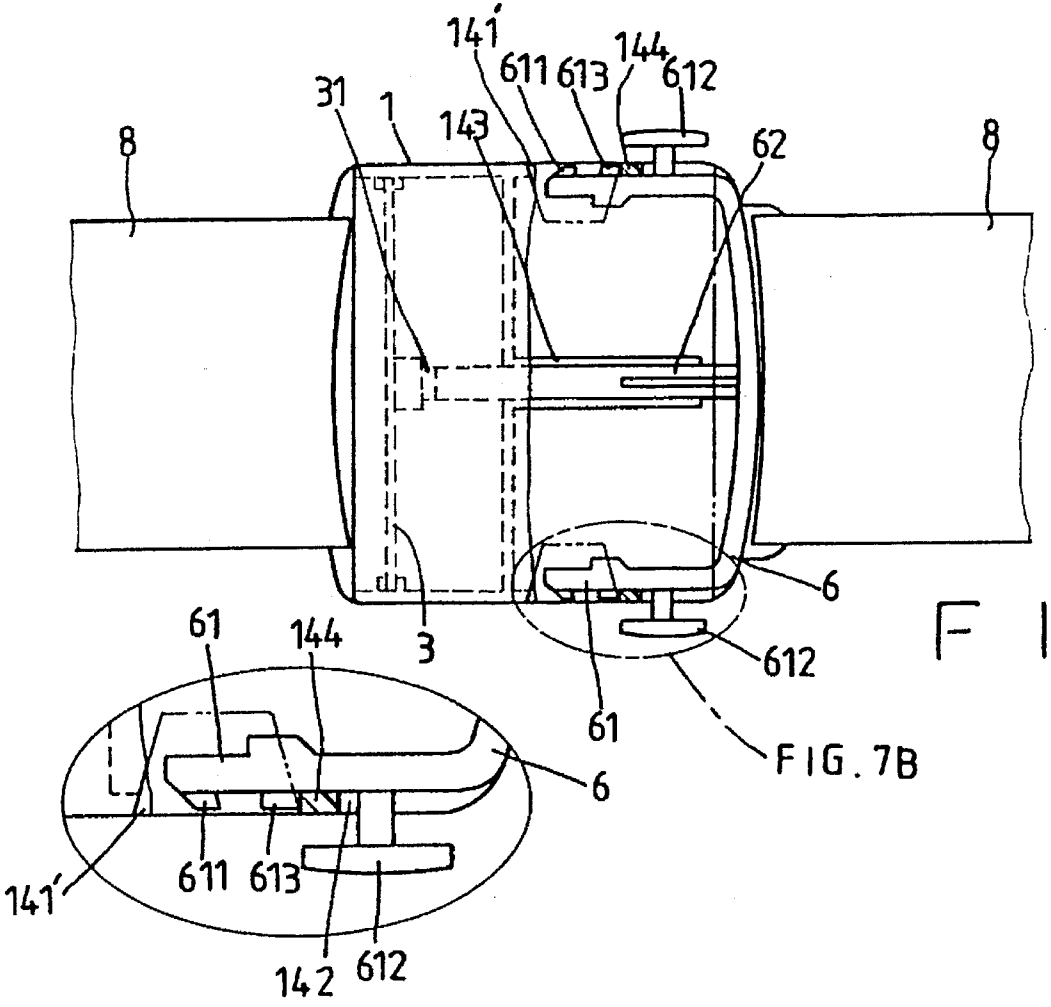
FIG. 7A is a bottom plan view, partially cut away, of the present invention showing the plug fully inserted into the socket.
FIG. 7B is an enlarged portion of the present invention shown in FIG. 7A.

Next, referring to FIGS. 7A and 7B, the push-button 612 on each plug rod 61 of the plug 6 is pressed down again and the plug 6 is pushed in further to position both the lugs 611 and the lugs 613 in the respective setting slot 141'. With the plug 6 in that position, the starting rod 62 contacts the push-button switch 31 of the driving circuit module 3, and switches it on, for starting the sources of luminosity to produce a warning light. Accordingly, the present invention can be set in a first fastening or second fastening position, depending upon the user's requirements. When usage is not desired, the plug 6 is set in the first fastening position to save power. For use, the plug 6 is set in the second fastening position to place the sources of luminosity in a working state. By this arrangement, mis-touching of the switch is avoided.

By providing more than two lugs 613 between the lug 611 and the push-button 612 and correspondingly extending the setting slot 141', more fastening positions can be provided. As each lug 613 is moved into the setting slot 141', another fastening position is achieved, thereby advancing the position of the starting rod 62 to control the push-button switch 31 to provide more operating states, not only lighting or extinguishing functions, but also flashing or other lighting sequences, for different warning purposes. Alternately, the plug 6 may be formed with one lug 611 on each side, and the first operation would not be changed. By forming more setting holes 141' along each side wall of the bell socket 14, more fastening positions can also be realized.

Figure 8:
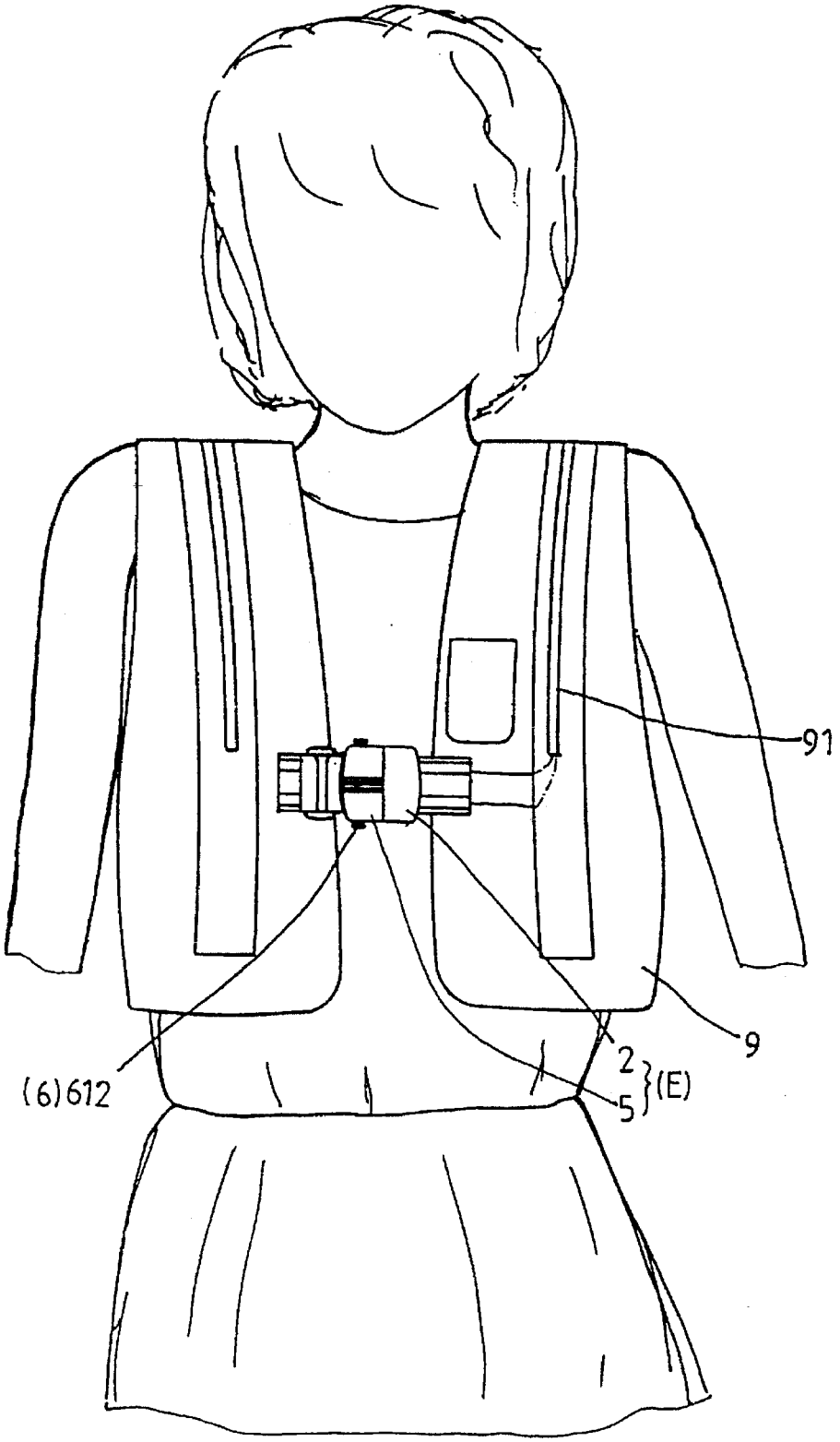
FIG. 8 is a depiction of the present invention incorporated into an alarm vest.

Referring to FIG. 8, the present invention can be incorporated into a safety vest, as opposed to a belt, for controlling sources of luminosity on the vest to illuminate. The present invention can also be incorporated into various knapsacks, and other attachments to the body.

I claim:

1. A fastener frame comprising:

a plug having a pair of elastic plug rods extending longitudinally from opposing ends of a connecting member and a starting rod extending longitudinally from said connecting member intermediate said pair of plug rods, each of said plug rods having at least one lug formed at a distal end thereof and a push-button longitudinally spaced from said at least one lug, said plug having an elongated slot formed in said connecting member for coupling to one end of a belt; and, socket means coupled to an opposing end of the belt for releasable coupling with said plug, said socket means including:

a. a case having an open top and being divided into a circuit compartment and a battery compartment by a spacer, said spacer having a through opening formed therein for passage of said starting rod therethrough;

b. a top member overlying said circuit compartment;

c. a battery cover releasably coupled to said case in overlying relationship with said battery compartment;

d. a bell socket disposed below a bottom wall of said battery compartment, said bell socket having a pair of side walls for receiving said pair of plug rods and said starting rod therebetween, each of said side walls having a guide slot formed therein and at least one setting hole formed therethrough for respective receipt of said at least one lug; and e. a driving circuit module disposed within said circuit compartment and having an output coupled to at least one source of luminosity, said driving circuit including a push-button switch disposed in aligned relationship with said spacer through opening for actuation by said starting rod responsive to insertion of said plug into said bell socket.

2. The fastener frame as recited in claim 1 where each of said plug rods have a plurality of lugs formed thereon, said plurality of lugs being disposed in longitudinally spaced relationship adjacent said distal end to provide incremental engagement with a respective setting hole of said bell socket and thereby incrementally advance said starting rod into engagement with said push-switch.

3. The fastener frame as recited in claim 1 where said top member has a flute formed in an upper surface thereof and said socket means further includes a transparent cover secured by said flute, an indicia carrying member disposed beneath said transparent cover, and a luminous source disposed beneath said indicia carrying member, said luminous source being electrically coupled to said driving circuit module.

4. The fastener frame as recited in claim 1 where said socket means further includes a sensor secured to an upper surface of said top member and electrically coupled to said driving circuit module for switching said driving circuit module on and off responsive to an ambient light level.

* * * * *